United States Patent [19]

Kanda et al.

[11] Patent Number: 4,585,529

[45] Date of Patent: Apr. 29, 1986

[54] METHOD FOR PRODUCING A METAL LITHOGRAPHIC PLATE

[75] Inventors: Katsumi Kanda, Kudamatsu; Katsunobu Kunimoto, Yamaguchi; Keiji Yamane; Yoshikazu Kondo, both of Kudamatsu, all of Japan

[73] Assignee: Toyo Kohan Co., Ltd, Tokyo, Japan

[21] Appl. No.: 547,563

[22] Filed: Nov. 1, 1983

Related U.S. Application Data

[62] Division of Ser. No. 326,747, Dec. 2, 1981, Pat. No. 4,445,998.

[51] Int. Cl.[4] ..... C25D 5/36; C25D 5/10

[52] U.S. Cl. ..... 204/27; 204/34; 204/38.1; 204/38.7; 204/40; 204/41

[58] Field of Search ..... 204/385, 40, 41, 34, 204/39, 17, 29, 38.1; 430/275, 302

[56] References Cited

U.S. PATENT DOCUMENTS

| | | | |
|---|---|---|---|
| 213,015 | 3/1879 | Wahl et al. | 204/34 |
| 1,072,091 | 9/1913 | Cowper-Coles | 204/40 |
| 1,614,303 | 1/1927 | Humphries | 204/41 |
| 2,291,854 | 8/1942 | Whyzmuzis | 204/41 |
| 3,433,720 | 3/1969 | Kupsis et al. | 204/34 |
| 3,691,030 | 9/1972 | Stroszynski | 204/32 R |
| 3,839,037 | 10/1974 | Fromson | 430/275 X |
| 4,188,215 | 2/1980 | Sato et al. | 430/156 |
| 4,287,288 | 9/1981 | Pigeon et al. | 430/169 |
| 4,336,113 | 6/1982 | Walls et al. | 204/17 |
| 4,371,430 | 2/1983 | Ballarini et al. | 204/32 R |

*Primary Examiner*—John F. Niebling
*Assistant Examiner*—William T. Leader
*Attorney, Agent, or Firm*—Wenderoth, Lind & Ponack

[57] ABSTRACT

A method for producing a metal substrate for a lithographic plate is provided herein by treating the substrate having the thickness in the range of 50 to 400 μm. The said substrate is electrochemically, chemically or mechanically treated in order to provide an average surface roughness in the range of 0.1 to 3 μm, followed by a surface treatment such as plating or chemical treatment, and then followed by a conventional hydrophilic treatment.

1 Claim, No Drawings

METHOD FOR PRODUCING A METAL LITHOGRAPHIC PLATE

This is a rule 60 divisional application of Ser. No. 326,747, filed Dec. 2, 1981, now U.S. Pat. No. 4,445,998.

FIELD OF THE INVENTION

The present invention relates to the method for producing a metal substrate for a lithographic plate, whereby the substrate is electrochemically, chemically or mechanically treated in order to improve the surface roughness, corrosion resistance and hydrophilic quality of a metal substrate, the said product having excellent water holding ability, hydrophilic quality, adhesion of photoresist and printability.

DESCRIPTION OF THE PRIOR ART

Lithographic printing is usually based on the principle that water cannot mix with ink oil. In the printing process, the surface of the metal lithographic plate consists of an ink-receptive image area and a hydrophilic non-image area. The entire surface of the metal lithographic plate is first soaked with water and then the ink-receptive image area repels water. However, the hydrophilic non-image area holds water.

Next, the surface of the metal lithographic plate is soaked with the printer's ink and the printer's ink only covers the ink-receptive image area. The said ink on the ink-receptive image area is transferred directly or through the blanket roll to the printing paper.

The image area consisting of the ink-receptive organic material, for example, light sensitive diazo resin, thermosetting resin or ultraviolet curing resin is formed on the metal lithographic plate by means of the photography or printing.

In the case of estimating the printability and the shelf life of the metal lithographic plate, it is important that the non-image area on the plate by hydrophilic. When the non-image area is poorly hydrophilic, the printer's ink causes stains, spots or scumming on the plate. When the non-image area becomes non-hydrophilic due to aging, the shelf life of the plate becomes short.

Adhesion to the ink-receptive organic material is an important factor in estimating the printability. The poor adhesion to the ink-receptive organic material causes the amount of the printing to decrease.

From these viewpoints, the various surface treatments are applied to the metal substrate for the lithographic plate.

For example, a metal substrate for the metal lithographic plate mainly consisting of aluminum is grained mechanically or etched electrochemically and then is subjected to the conventional hydrophilic treatment. An aluminum sheet substrate is so expensive that a thin aluminum or aluminum alloy sheet substrate is used for the metal lithographic plate. But the thinner the aluminum or aluminum alloy sheet substrate, the weaker its strength. Therefore, an aluminum or aluminum alloy sheet substrate having a thickness of 0.3 mm is usually used for the metal lithographic plate. In the case of a thickness under 0.3 mm, an aluminum or aluminum alloy sheet substrate is used for small amount of printing.

There are many inventions relating to processes for production of metal lithographic plates by using an aluminum or aluminum alloy sheet substrate. But these processes are so complicated, as described above, that the plates are expensive.

Therefore, it is an object of the present invention to produce an economical metal substrate having excellent properties.

BRIEF SUMMARY OF THE INVENTION

A metal substrate for a metal lithographic plate having a thickness in the range of 50 to 400 μm is electrochemically, chemically or mechanically treated in order to exhibit an average surface roughness in the range of 0.1 to 3 μm, and is subjected to a surface treatment such as plating or chemical treatment, and then to a conventional hydrophilic treatment.

DETAILED DESCRIPTION OF THE INVENTION

The detailed method according to the present invention will be described below.

The metal substrate for the metal lithographic plate may include a steel sheet and steel foil, said metal substrate having a thickness in the range of 50 to 400 μm.

The average surface roughness of said metal substrate in the range of 0.1 to 3 μm is suitable for improving the hydrophilic quality. The average roughness of more than 3 μm has a remarkably bad influence on the image produced. In order to roughen the surface, said metal substrate must be grained, etched chemically or electrochemically, or electroplated with iron.

In order to improve the corrosion resistance of a metal substrate, after roughening the surface, the plating or the chemical treatment is applied on the metal substrate by the following methods:

(1) Plating with a metal such as chromium, nickel, copper, tin or zinc,
(2) Alloy plating with the alloys of said metals,
(3) Plating with multi-layers of said metals, and
(4) Chemical treatment (dipping or electrolysis) in the treatment solution containing chromate, phosphate, molybdate, silicate, borate, perborate or aluminate.

The said surface treatment is improved not only in corrosion resistance but also in adhesion to the ink-receptive organic material.

Also, in the case of electroplating, a suitable surface roughness for the metal lithographic plate is obtained by forming electrodeposited nuclei (or crystals). Therefore, it is necessary in the electroplating to impart roughness to the base substrate.

The thickness of the electrodeposited material must be selected from the standpoint of economy and corrosion resistance of the metal substrate, in the case of electroplating with an expensive metal such as chromium or nickel.

Even if the said metal substrate is suitable for the metal lithographic plate, its hydrophilic quality is deteriorated by aging. Therefore, a further hydrophilic treatment is performed on said metal substrate. The hydrophilic treatment is usually applied by a well-known method, for example, employing silicates, zircofluorides, organic titanium compounds, organic phosphoric acid, ferrocyanide, ferricyanide, organic polymer coating consisting of polyacrylic acid or carboxymethyl cellulose, gallic acid, phosphotungstate, or inorganic compound sol.

The method employing a sol of an inorganic compound is especially suitable for the hydrophilic treatment, and is described in detail below.

The water-dispersible sol of a metal compound, which is one of the main components, has the effect of improving the hydrophilic quality, the corrosion resistance and printability. The said hydrophilic treatment may be applied to one or both sides of a metal substrate.

The water-dispersible sol may include a compound (oxide or hydroxide) of a metal such as aluminum, titanium, zirconium, silicon, chromium, nickel, zinc, tin, manganese, copper, cobalt, iron, lead, cadmium, magnesium or calcium and any metal compound which can positively charge the suspension. The diameter of the particle is 1 to 500 μm. In order to stabilize the metal compound sol in the suspension, a stabilizing additive may also be included in the treatment solution. For example, an inorganic acid such as chromic acid or phosphoric acid, an organic acid such as citric acid or acetic acid, and a surface active agent may be employed. At least one sol of a metal compound may be added to the suspension.

A concentration of metal compound sol in the range of 1 to 100 g/l (as solid) is suitable for improving the hydrophilic quality. A concentration of less than 1 g/l has little effect on the hydrophilic quality and conversely, a concentration of more than 100 g/l has a very adverse effect on the appearance of the metal lithographic plate and is uneconomical.

Said sol is positively charged in the suspension and is easily and strongly absorbed on said metal substrate. The hydrophilic treatment can be applied by dipping or electrolysis in the suspension containing the sol compound.

In the case of electrolysis treatment, as the sol of the metal compound is positively charged in the suspension, the metal substrate is cathodically treated in said suspension.

The sol absorbed by the electrolysis treatment is bonded to the metal substrate more strongly than that of sol absorbed by the dipping treatment.

In order to stabilize the sol of a metal compound in the suspension, an agent such as chromic acid, phosphoric acid, acetic acid, chloric acid or sulphuric acid may be added. When chromic acid or phosphoric acid is added, the hydrophilic film layer formed on the metal substrate has excellent corrosion resistance. In the case of a steel substrate or steel foil substrate, said method is especially desirable.

As the hydrophilic film layer formed is bonded strongly to a metal substrate, and does not contain an alkali compound, the ink-receptive organic material does not peel from the metal substrate during the printing. The presensitized plate according to the present invention has a higher printing capacity than the conventional lithographic printing plate.

Specific embodiments of the present invention are as follows:

EXAMPLE 1

A cold-rolled steel foil having a thickness of 100 μm was treated by the method of the present invention.

Treatment of the present invention:

A. Graining treatment for improving the surface roughness.

A cold-rolled steel foil was electroplated with iron (chloride bath) to 5 μm. The average surface roughness was 0.6 μm.

B. Surface treatment for improving the surface roughness, corrosion resistance and printability.

A steel foil substrate treated by A was electroplated with chromium by treating for 20 seconds in a Sargent bath at a cathodic current density of 40 A/dm$^2$ and a temperature of 45° C.

C. Hydrophilic treatment for improving printability and corrosion resistance.

A steel foil substrate treated by A and B was dipped for 10 seconds in the suspension consisting of alumina sol (particle diameter: 50 μm) of 30 g/l (trade name: AS-200, Nissan Chemical Industries, Ltd.) and chromium trioxide of 5 g/l and then was dried.

EXAMPLE 2

A cold-rolled steel substrate having the thickness of 200 μm was treated by the method of the present invention.

Treatment of the present invention:

A. Graining treatment for improving the surface roughness.

One side of a steel substrate was etched in the solution of 40° Be of $FeCl_3$. The average surface roughness of the steel substrate formed was 0.8 μm.

B. Surface treatment for improving corrosion resistance and printability.

A steel substrate treated by A was electroplated with zinc by using the sulfate bath at a cathodic current density of 5 A/dm$^2$ and at a electrolyte temperature of 50° C. The thickness of zinc deposit was 4 μm.

C. Hyrophilic treatment for improving printability.

A steel substrate treated by A and B was cathodically treated for 30 seconds in the suspension consisting of the chromium compound sol of 20 g/l and phosphoric acid of 10 g/l at a cathodic current density of 2 A/dm$^2$. After rinsing with water, the steel substrate was dried.

EXAMPLE 3

A cold-rolled steel substrate having the thickness of 300 μm was treated by the method of the present invention.

Treatment of the present invention:

A. Graining treatment for improving the surface roughness.

A cold-rolled steel substrate was electroplated with iron by treating for 8 minutes in a solution consisting of ferrous sulfate of 400 g/l and ammonium sulfate of 100 g/l at a cathodic current density of 30 A/dm$^2$ and at an electrolyte temperature of 50° C. The thickness of the iron deposit formed was 50 μm. The average surface roughness of the iron plated steel substrate was 1.6 μm.

B. Surface treatment for improving printability and corrosion resistance.

A said steel substrate treated by A was coated with nickel by treating for 20 seconds in Watts bath at a current density of 20 A/dm$^2$ and at a temperature of 40° C.

C. Hydrophilic treatment for improving printability.

A steel substrate treated A and B was coated with gum arabic solution to the thickness of 5 μm and was dried.

EXAMPLE 4

A cold-rolled steel foil substrate having the thickness of 100 μm was treated by the method of the present invention.

Treatment of the present invention:

A. Graining treatment for improving surface roughness.

A cold-rolled steel foil substrate was grained by sand. The average surface roughness was 2.5 μm.

B. Surface treatment for improving printability and corrosion resistance.

Said steel foil substrate treated by A was electroplated with nickel by treating in a Watts bath at a current density of 5 A/dm$^2$ and at a temperature of 50° C. The thickness of nickel deposit was 0.2 μm. And then the said nickel plated steel foil substrate was electroplated with chromium by treating in a Sargent bath at a cathodic current density of 40 A/dm$^2$ and at a electrolyte temperature of 45° C. The thickness of chromium deposit was 0.5 μm.

C. Hydrophilic treatment for improving printability.

Said steel foil substrate treated by A and B was cathodically treated for 30 seconds in the suspension consisting of phosphoric acid of 50 g/l and the sol of zirconium compound (the average particle diameter of 50 mμ) of 10 g/l at cathodic current density of 2 A/dm$^2$ and then was rinsed with water and was dried.

EXAMPLE 5

The steel sheet substrate subjected to treatment A of Example 2 was electroplated with chromium by treating in a Sargent bath at a cathodic current density of 40 A/dm$^2$ and at an electrolyte temperature of 45° C. The thickness of chromium deposit was 0.1 μm. The said chromium plated steel sheet substrate was coated with gum arabic solution to 1 μm thickness and dried.

COMPARATIVE EXAMPLE 1

The steel sheet substrate was treated by the same A treatment as described in Example 2. The average surface roughness was 0.8 μm. B and C treatments, as described in the above Examples, were not applied to the said steel sheet substrate.

COMPARATIVE EXAMPLE 2

The steel sheet substrate having the thickness of 0.3 mm was treated to attain an average surface roughness of 0.05 μm. B and C treatments, as described in the above Examples, were not applied to the said steel sheet substrate.

COMPARATIVE EXAMPLE 3

A commercial presensitized plate (aluminum sheet substrate: thickness of substrate . . . 0.3 mm, FUJI FILM PRESENSITIZED OFFSET PLATE, Fuji Film Co., Ltd., Japan).

Evaluation: The metal substrates which were prepared in Examples 1, 2, 3, 4 and 5, and in Comparative Examples 1, 2 and 3 were evaluated by the following text methods. The results were shown in Table 1.

(1) Hydrophilic quality: Hydrophilic quality was evaluated by measuring the contact angle (water).

Contact angle

<30° . . . O

30°–50° . . . Δ

>50° . . . x (2) Adhesion to the ink-receptive organic material.

A piece of adhesive tape was applied firmly to the ink-receptive organic material (image area) and then was pulled off quickly.

The image area was formed on the test pieces by curing a light-sensitive resin (a quick-wipe-on negative working, Ueno Chemical Industries, Ltd.). The said light-sensitive resin was cured by ultraviolet.

O means that no adhesion loss of the image area was found.

x means that adhesion loss of the image area was found.

TABLE 1

| | Characteristics of treated sample | | | |
|---|---|---|---|---|
| | Hydrophilic quality | | Adhesion to the ink-receptive organic material | |
| Sample | immediately after producing | after aging for 3 months | immediately after producing | after aging for 3 months |
| Example 1 | o | o | o | o |
| Example 2 | o | o | o | o |
| Example 3 | o | o | o | o |
| Example 4 | o | o | o | o |
| Example 5 | o | o | o | o |
| Comparative Example 1 | Δ | x (red rust) | x | x |
| Comparative Example 2 | x | x (red rust) | x | x |
| Comparative Example 3 | — | — | o | o |

The printing capacity of said Examples was determined by printing on a press. Each metal lithographic plate of Example 1, 2, 3, 4 and 5 can print forty thousand of the printing papers without problems such as stains, spots or scumming.

What we claim is:

1. A method for producing a substrate for a steel lithographic plate which consists essentially of:

(a) subjecting a steel substrate having a thickness in the range of 50 to 400 μm, to a graining treatment by (i) electroplating with iron or (ii) etching in a solution containing ferric ions, in order to impart to said substrate an average surface roughness in the range of 0.1 to 3 μm, and (b) imparting improved corrosion resistance to the substrate of step (a) by electroplating with chromium, nickel, tin or zinc, an alloy of said metals or multi-layer of chromium, nickel, tin or zinc to a maximum thickness of 4 μm, and then (c) applying a hydrophilic coating of a silicate, organic titanium compound, organic phosphoric acid, ferrocyanide, ferricyanide, organic polymer coating consisting of polyacrylic acid or carboxymethyl cellulose, gallic acid, phosphotungstate or gum arabic to the treated substrate step (b).

* * * * *